US011965408B2

(12) United States Patent
Kuckes et al.

(10) Patent No.: US 11,965,408 B2
(45) Date of Patent: Apr. 23, 2024

(54) MAGNETIC BOREHOLE SURVEYING METHOD AND APPARATUS

(71) Applicant: Vector Magnetics, LLC, Ithaca, NY (US)

(72) Inventors: Arthur F. Kuckes, Ithaca, NY (US); Mariano S Garcia, Ithaca, NY (US)

(73) Assignee: Vector Magnetics, LLC, Ithaca, NY (US)

( * ) Notice: Subject to any disclaimer, the term of this patent is extended or adjusted under 35 U.S.C. 154(b) by 94 days.

(21) Appl. No.: 17/516,048

(22) Filed: Nov. 1, 2021

(65) Prior Publication Data

US 2022/0136380 A1 May 5, 2022

Related U.S. Application Data

(60) Provisional application No. 63/108,213, filed on Oct. 30, 2020.

(51) Int. Cl.

| | |
|---|---|
| ***E21B 44/02*** | (2006.01) |
| ***E21B 7/04*** | (2006.01) |
| ***E21B 47/024*** | (2006.01) |

(52) U.S. Cl.

CPC ..... *E21B 44/02* (2013.01); *E21B 7/04* (2013.01); *E21B 47/024* (2013.01)

(58) Field of Classification Search

CPC ..... E21B 7/04; E21B 47/024; G01P 21/00; G01D 18/00; G01C 25/00; G01C 25/005; G01R 35/00; G01R 35/005

See application file for complete search history.

(56) References Cited

U.S. PATENT DOCUMENTS

| | | | | |
|---|---|---|---|---|
| 4,901,804 | A * | 2/1990 | Thometz | E21B 47/00 175/45 |
| 5,410,303 | A * | 4/1995 | Comeau | E21B 47/022 340/856.1 |
| 5,513,710 | A * | 5/1996 | Kuckes | E21B 47/0232 175/45 |
| 6,466,020 | B2 * | 10/2002 | Kuckes | E21B 47/0228 175/45 |
| 8,947,094 | B2 * | 2/2015 | McElhinney | G01V 3/26 175/45 |
| 10,053,978 | B2 * | 8/2018 | Hay | E21B 49/00 |
| 10,161,246 | B1 * | 12/2018 | Hay | E21B 49/00 |
| 10,408,963 | B2 * | 9/2019 | Wu | G01V 3/38 |
| 10,890,062 | B2 * | 1/2021 | Rodney | E21B 44/00 |
| 11,299,975 | B2 * | 4/2022 | Harvey | E21B 7/06 |

(Continued)

FOREIGN PATENT DOCUMENTS

| | | | | |
|---|---|---|---|---|
| CA | 2614505 C | * | 4/2014 | E21B 47/022 |
| CN | 103649450 A | * | 3/2014 | E21B 47/022 |

(Continued)

*Primary Examiner* — Jennifer H Gay

(74) *Attorney, Agent, or Firm* — Bond, Schoeneck & King, PLLC; Frederick J.M. Price

(57) ABSTRACT

Measurement of the inclination and azimuthal direction of a borehole extending beneath an obstacle, such as a body of water, which utilizes magnetic and gravity sensors at the drill bit of a borehole being drilled. Embodiments of the present invention determine and remove remanent field components and the effects of ferromagnetic permeability prior to and during drilling of the borehole.

15 Claims, 10 Drawing Sheets

(56) References Cited

U.S. PATENT DOCUMENTS

2003/0085059 A1* 5/2003 Kuckes ..... E21B 47/024 175/45
2003/0209365 A1* 11/2003 Downton ..... E21B 47/00 166/250.11
2006/0164073 A1* 7/2006 Bergsma ..... G01R 33/0206 324/202
2011/0006773 A1* 1/2011 Bittar ..... E21B 47/0228 324/333
2011/0088890 A1* 4/2011 Clark ..... G01B 7/30 175/45
2013/0069655 A1* 3/2013 McElhinney ..... E21B 47/0228 324/346
2013/0226459 A1* 8/2013 Gorek ..... E21B 47/024 702/7
2013/0239650 A1* 9/2013 Chau ..... G01P 15/08 73/497
2013/0285665 A1* 10/2013 Wu ..... G01V 3/38 324/339
2015/0106016 A1* 4/2015 Wu ..... G01V 3/30 702/6
2015/0226050 A1* 8/2015 Bartel ..... E21B 47/18 700/275
2015/0331138 A1* 11/2015 Estes ..... G01V 13/00 324/346
2016/0003029 A1* 1/2016 Hay ..... E21B 47/01 702/9
2016/0258288 A1* 9/2016 Hay ..... G01V 3/28
2017/0138174 A1* 5/2017 Kuckes ..... E21B 7/046
2017/0328192 A1* 11/2017 Wessling ..... E21B 47/06
2019/0271227 A1* 9/2019 Peters ..... E21B 47/14
2020/0270981 A1* 8/2020 Rodney ..... E21B 7/067
2020/0340351 A1* 10/2020 Harvey ..... E21B 44/04
2021/0103843 A1* 4/2021 Keller ..... E21B 7/06
2021/0189861 A1* 6/2021 Rodney ..... E21B 47/024
2021/0254448 A1* 8/2021 Phillips ..... E21B 47/022
2021/0348504 A1* 11/2021 Xue ..... E21B 47/14
2022/0136380 A1* 5/2022 Kuckes ..... E21B 7/10 175/24

FOREIGN PATENT DOCUMENTS

CN 105737855 A * 7/2016
CN 105806364 A * 7/2016
CN 106525073 A * 3/2017 ..... G01C 25/005
CN 106640046 A * 5/2017
CN 107121707 A * 9/2017 ..... G01R 33/02
CN 109813336 A * 5/2019
GB 2398127 A * 8/2004 ..... E21B 47/022

* cited by examiner

MAGNETIC BOREHOLE SURVEYING METHOD AND APPARATUS

REFERENCE TO RELATED APPLICATIONS

This application claims one or more inventions which were disclosed in Provisional Application No. 63/108,213 filed Oct. 30, 2020, entitled "MAGNETIC BOREHOLE SURVEYING METHOD AND APPARATUS". The benefit under 35 USC § 119(e) of the United States provisional application is hereby claimed, and the afore-mentioned application is hereby incorporated herein by reference.

BACKGROUND OF THE INVENTION

Field of the Invention

The present invention relates to a method and apparatus for surveying generally horizontal boreholes below the Earth's surface, and more particularly to a system for detecting and precisely locating a drill head in a borehole with respect to a known location, for use in guiding the drilling of the borehole to a specified location.

Description of Related Art

Horizontal directional drilling techniques are well known and have long been used to drill boreholes which cross under areas where trenching is not permitted or is impractical. For example, such techniques are used to drill boreholes under man-made or natural obstacles, such as bodies of water, rivers or lakes, and under highways, airport runways, and housing developments. These boreholes may be used, for example, to position pipelines, underground transmission lines, communications lines such as optical fibers, and other utilities, and often must be drilled within defined areas, must travel long distances, and must exit the ground at predetermined locations.

Conventional directional drilling techniques used to drill such boreholes using a steering tool with magnetometer and accelerometer sensors to determine the borehole inclination, azimuth, and tool roll angle at each station where measurements are made. The borehole coordinates are computed and tabulated from the steering tool data as a function of the measured distance along the borehole, which may be referred to as the measured depth of the steering tool. These borehole coordinates suffer from serious cumulative effects caused by the inclination and azimuth determinations made at regularly spaced stations along the borehole, and the lateral errors generated by such conventional borehole surveying are intolerable. The inherent imprecision of this integration has caused a turn towards electromagnetic methods to directly determine drill bit location. However, determination of the radial away distance from the entry point to the drill bit is quite precise since a borehole normally changes direction slowly and modestly in both inclination and azimuth along its length. Thus, if a borehole has been following a curved proposal design path and has not deviated 1 degree in direction from the design path direction for 500 meters of drilling, the lateral error with respect to that design proposal would be 8 meters, whereas the radial "away" error would be less than 1 meter.

An important aspect of drilling boreholes for pipeline and cable burial projects is the requirement that the borehole exit at the Earth's surface at a precisely predetermined location. In order to do this, the driller must have a direct determination of lateral position, and reaffirmation of the precise radial distance to the exit location at a distance from that exit point so that appropriate adjustments to the inclination of drilling can be made.

A further important concern in drilling is responding to a sudden and unexpected deflection of the borehole by up to several degrees due to hitting boulders or other obstacles. Immediate correction of such a drilling direction perturbation can be more important than immediate correction of a displacement error since such direction perturbations can lead to a tortuous borehole, which is a very serious defect particularly when attempting to pull a pipe through the completed borehole. Steering tool inclinometers provide good inclination measurements, usually to a precision of 0.1 or 0.2 degrees; thus, good control exists in inclination. However, the magnetometers used to determine azimuthal direction in the horizontal plane may be subject to larger errors. In addition to being intrinsically much less precise than the inclinometers because of steel in the drill string, motor and drill bit, magnetometers are also subject to sudden environmental changes from steel and magnetized objects in the vicinity of the borehole and by nearby auto, truck, train, and ship traffic.

Still other attempts to provide improved drill guidance include the use of an externally generated magnetic field produced by one or more current loops made up of straight-line segments, where the fields are measured by a probe at the drill, the probe having three orthogonal magnetometers which measure x, y and z components of the magnetic field. Three inclinometers measure the rotation and inclination of the probe with respect to gravity, and the data is used to determine the spatial orientation of the magnetic field vector at the magnetometers. A theoretical magnetic field vector is then calculated and compared to the measured vector to determine the location of the probe.

In many cases the primary drilling direction and location data communicated to the Earth's surface are provided by a steering tool with sensors that may be 15 meters behind the drill bit, which greatly degrades the quality of the borehole produced.

Although some of these prior systems have been adequate for many applications, they have not been totally satisfactory, and there exists a need for an improved borehole surveying method which will permit accurate and reliable location of drill heads to enable boreholes to be drilled along preselected paths to distant locations.

SUMMARY OF THE INVENTION

According to one embodiment of the present invention, a method for measuring drilling direction azimuth and inclination perturbations and an apparatus at the drill bit for measuring drilling direction azimuth and inclination perturbations is disclosed.

In another embodiment of the present invention, a method of calibrating a magnetic and gravity direction sensor package at the drill bit is used. During drilling downhole, a check procedure can also be used which can monitor some calibration values to determine if recalibration is needed.

In another embodiment of the present invention, a magnetic and gravity direction sensor package at the drill bit i.e., an At-Bit Inclination and Azimuth (ABIA) tool, enables the driller to recognize changes in drilling inclination and azimuth as soon as they occur and make timely adjustments to the drilling.

DETAILED DESCRIPTION OF THE INVENTION

Figure 1:
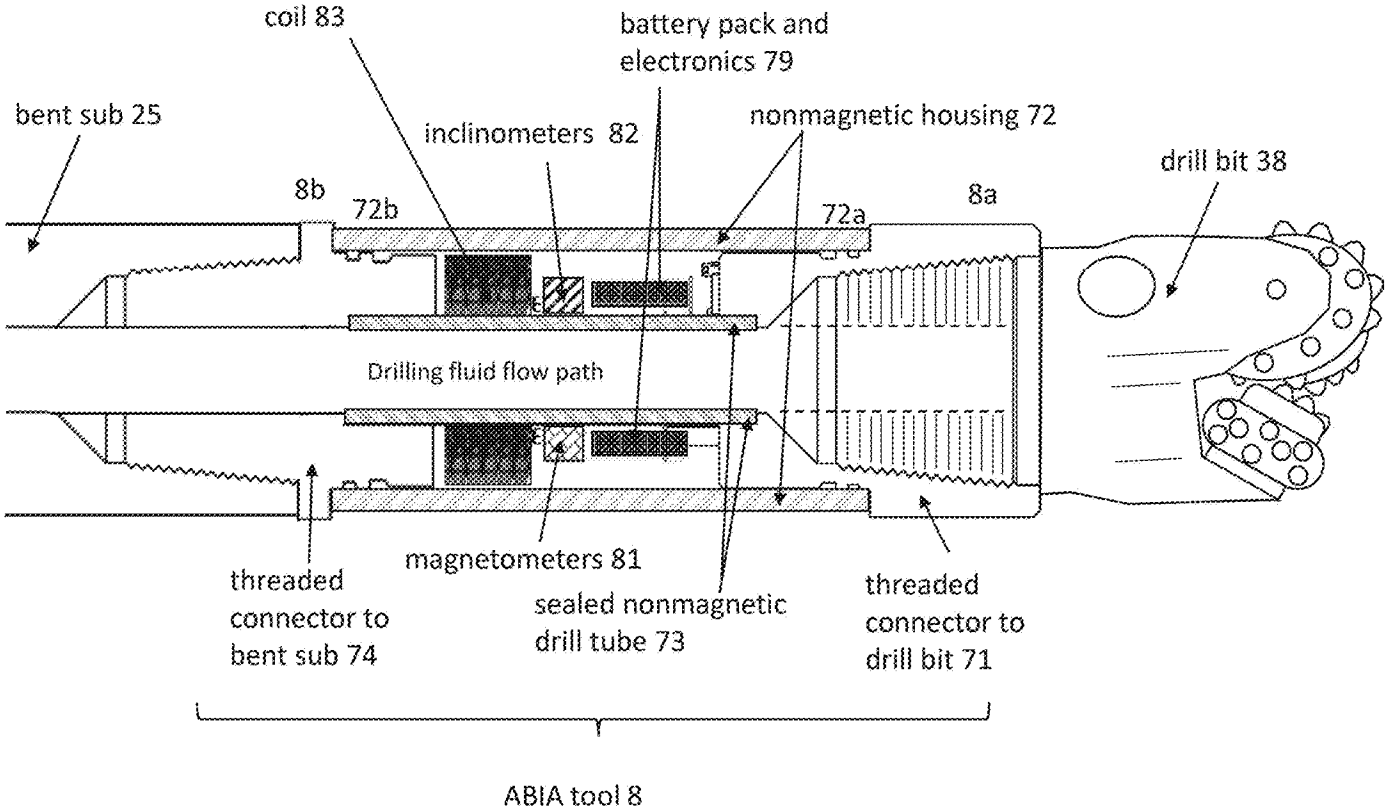
FIG. 1 shows an At-Bit Inclination and Azimuth (ABIA) instrument package.
Figure 2:
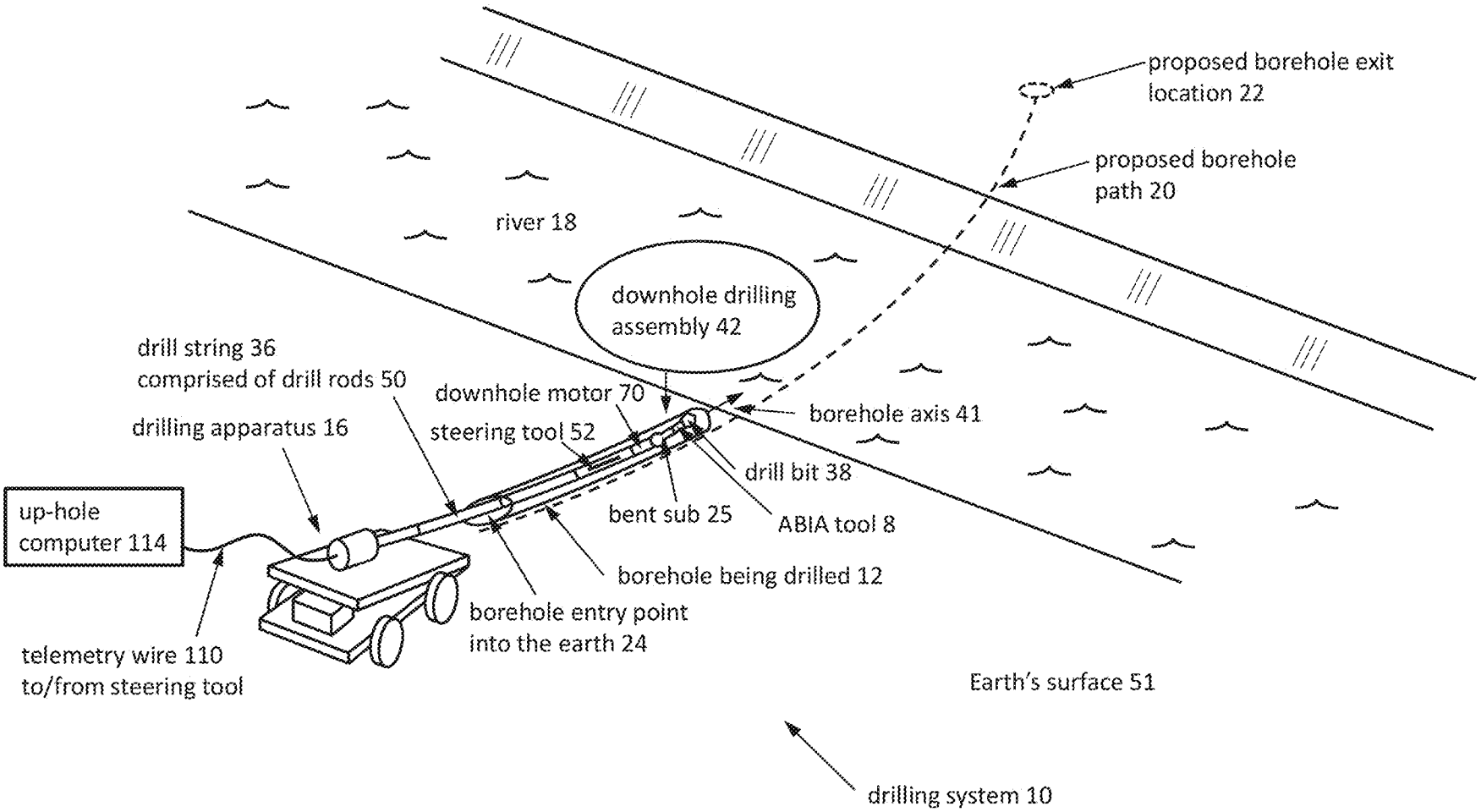
FIG. 2 shows diagrammatic depiction of a tunneled borehole following a prescribed path under the direction of the tracking system of the present invention.

FIG. 2 shows a drilling system 10 which includes a down-hole apparatus near the drill bit 38 for guiding a borehole drilling operation (in an approximately horizontal direction). The down hole portion 42 of the apparatus consists of a drill rod 50, downhole motor 70 (see FIG. 1), and a "bent sub" 25 near the drill bit 38. The drill bit 38 is rotated either by the entire drill string 36 or by a downhole motor 70 powered by pressurized fluid. The direction of drilling is controlled by changing the source of rotational power while modulating the orientation of the bent sub 25 (see FIG. 3). A conventional steering tool 52 is located in a specialized drill rod called a "drill collar" 53 approximately 15 meters behind the drill bit 38. The drill collar is generally made of non-magnetic material, allowing the steering tool 52 to use uncorrupted magnetometer and accelerometer data from its own sensors 34, 35 to calculate position and orientation and then communicate the information to the Earth's surface 51 via wireline, such as telemetry wire 110 or other methods. The method of the present invention uses an additional "ABIA" tool 8 (shown in FIG. 1) collecting gravity and magnetic sensor data immediately behind the drill bit 38 to determine the Earth Magnetic field vector (Ef) and the three components of the gravity vector G. From these measurements the borehole inclination (Inc), the roll angle of the tool (RA), and (4) the azimuth (AZ) of the drilling direction can be calculated immediately behind the drill bit.

As embodied herein, and depicted in FIG. 2, is a diagrammatic depiction of a tunneled borehole following a prescribed path under the direction of the drilling system 10 of the present invention is disclosed. Specifically, FIG. 2 shows a generally horizontal borehole 12 that is following a prescribed path 20 under the direction of the tracking system of the present invention. In this view, the borehole 12 is being tunneled under an obstacle (e.g., river 18) to install, e.g., a pipeline, power transmission lines, fiber optic cables, communication lines, etc. The drilling system 10 is configured to guide the drilling apparatus 16 such that the drilling follows a predetermined path 20 at a predetermined vertical depth (e.g., about 30 meters) to a planned exit location 22. The predetermined path may traverse a great distance, e.g., 1,000 meters, 2-3 miles, etc.

The system 10 includes a telemetry wire 110 disposed between a down-hole portion of the system, past the borehole entry point 24 in the Earth (which includes a steering tool 52 and ABIA tool 8) and an up-hole portion of the system (including up-hole control system and processor 114). The telemetry wire 110 interconnects the up-hole and down-hole portions via the drilling apparatus 16 and the drill rod 50. The telemetry wire function may be replaced by other techniques such as mud-pulse or acoustic signaling, electromagnetic transmissions, or other methods known to those skilled in the art.

The ABIA tool 8 of an embodiment of the present invention is shown in FIG. 1. The ABIA tool 8 has a first end 8*a* with a threaded connector 71 to a drill bit 38 and a second end 8*b* threaded to a bent sub 25 driven in turn by a downhole hydraulic motor 70. A nonmagnetic housing assembly 72 has a first end 72*a* connected to the threaded connector 71 and extending a length to a second end 72*b* connected to the threaded connector 74 which is attached to the bent sub 25. Within the nonmagnetic housing assembly 72 is a hollow, nonmagnetic, sealed central drill fluid tube 73 which is connected to the drill bit 38 and the downhole hydraulic motor 70 via the bent sub 25. Within the housing assembly 72 and surrounding the drill fluid tube 73 is a battery pack and associated electronics 79, three-axis magnetic field sensors 81, three-axis inclinometers 82 and a solenoidal alternate current (AC) magnetic coil 83. The AC magnetic coil 83 is used for communication with the up-hole computer 114 via the steering tool 52.

The three single axis magnetic field sensors 81 and the three single axis inclinometers 82 are preferably perpendicular to each other and to the drilling axis 41. It is noted that conventional at-bit inclination apparatus tools only include inclinometers at the drill bit, but not magnetometers as in the present invention and therefore cannot measure the azimuth.

Figure 3:
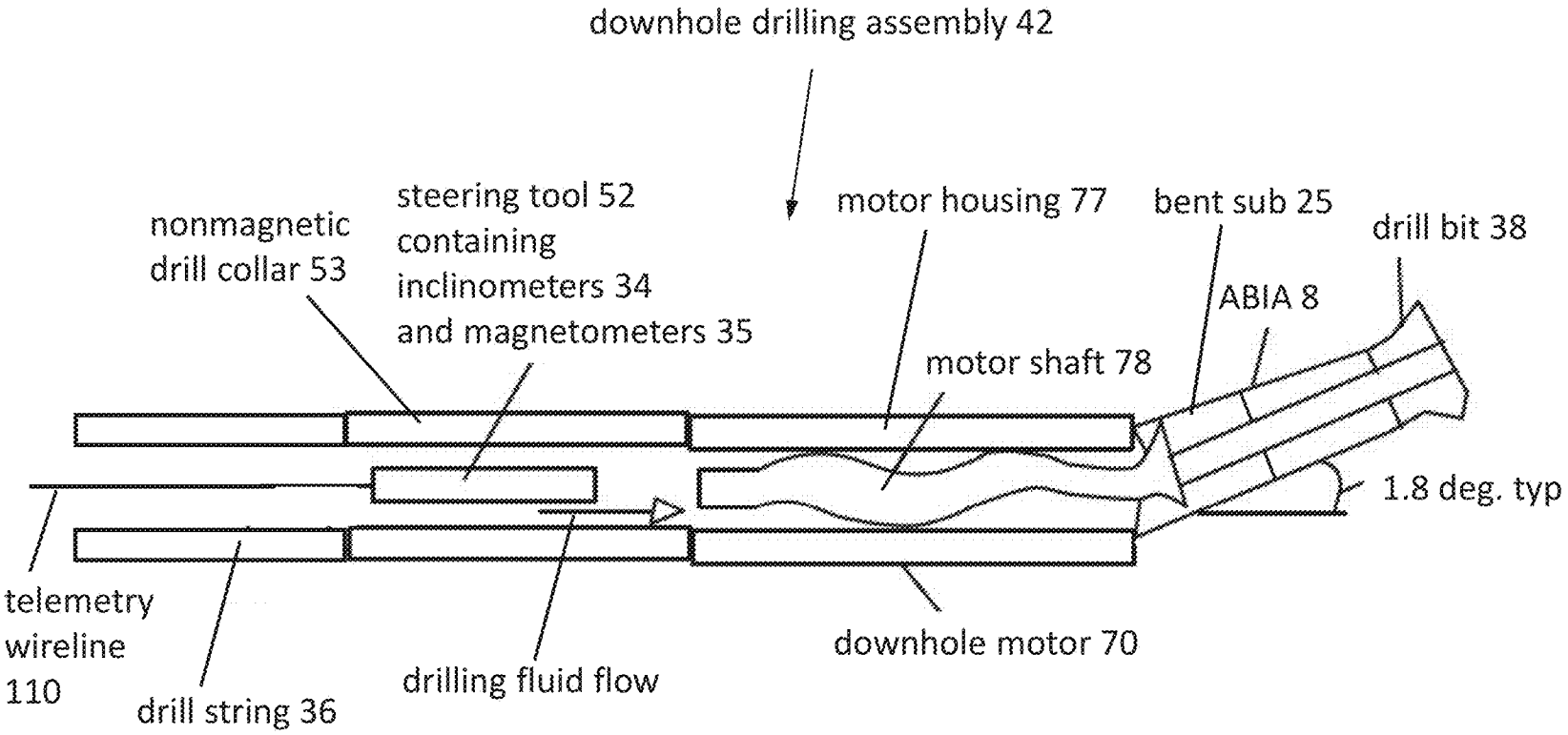
FIG. 3 shows a downhole drilling assembly.

FIG. 3 shows a downhole drilling assembly 42. The downhole drilling assembly 42 includes a drill string 36 comprised of drill rods 50. At the end of the string 36, the steering tool 52 is located inside a special-purpose nonmagnetic rod called a drill collar 53. The drill collar 53 is attached to a downhole motor 70 which can rotate the drill bit 38 via a motor shaft 78. Between the downhole motor 70 and the drill bit 38 is the bent sub 25 including an ABIA 8. Drilling fluid flows through the drills string 36, within the nonmagnetic drill collar 53, around the motor shaft 78, within the motor housing 77 and through the bent sub 25 to the drill bit 38.

Measurements at a given location are used to direct further drilling. A driller uses the ABIA tool 8, together with a drilling assembly 10, as well as a steering tool 52 having a complement of magnetometers 34 and inclinometers 35. It is noted that the magnetometers 34 and inclinometers 35 of the steering tool 52 are separate from the ABIA inclinometers 82 and magnetometers 81 at the drill bit 38 and disclosed below. Typically, drilling stops every 10-15 meters to attach a new section of the drill string 36, the depth of the borehole being drilled is determined, and the steering tool 52 is operated to measure the current azimuth, inclination, and roll angle of the steering tool at the present location and the ABIA tool 8. The ABIA tool 8 is also operated to ascertain that no serious drilling aberrations have occurred. These measurements are analyzed and are used to plan the drilling of the next 10-15 meter joint of the borehole path.

The present invention addresses the issues of the difficulty to make steering corrections from data measurements made 10-15 meters behind the drill bit 38 by placing magnetometers 81 and inclinometers 82 at the drill bit 10 thereby enabling the initiation of drilling adjustments at the first possible moment. Embodiments of the present invention solve several difficulties in placing inclinometers and magnetometers at the drill bit 38, from the steel construction of the drill bit 38 itself and of the difficulty of passing electric current-carrying wires to the ABIA tool 8 through the downhole motor 70.

Operation of an ABIA tool 8 requires electric power for the sensors 81, 82 to operate, to execute data processing, to activate and deactivate the magnetometer and inclinometer sensors 81, 82, and to communicate results to the steering tool 52 using the coil 83. Thus, a battery pack 79 is included in the ABIA tool 8. Communication to the ABIA tool 8 from the Earth's surface 51 is done by modulating the drill bit 38 rotation rate. ABIA tool measurements are made simultaneously to a standard steering tool 52. The steering tool 52 telemeters a continuous sequence of magnetic and gravity data to the surface of the Earth 51 as the data is generated. At the end of this period, 30 or 40 bits of the compressed data, which were sent electromagnetically via a solenoidal AC magnetic coil 83 from the ABIA tool 8 to the steering tool 52, are telemetered to the Earth's surface 51, for example via telemetry wire 110.

Flux gate magnetometers 81, inclinometers 82 (i.e., DC accelerometers), and data processing circuits can have very low power requirements and be left operating continuously to detect "start" bit drilling rotation variations modulation at any time. The ABIA tool 8 is approximately 10-15 meters deeper than the steering tool 52. It is used as an "add on" to augment the steering tool borehole surveying method and apparatus, such as apparatus as described in U.S. Pat. No. 6,466,020.

The ABIA tool inclinometers 82 measure the drill bit inclination and rotation angle. The borehole inclination measured by these accelerometer sensors 82 may differ from the actual borehole inclination because of the bent sub 25 angle of about 2 degrees. At each survey station the driller, as a matter of course sets the "motor bent sub" to point upwards to obtain consistent results.

ABIA data bits are encoded, and then transmitted, using the electromagnetic coil 83 in the ABIA to the steering tool 52. The data is detected and collected by magnetometers 35 in the steering tool 52 of the steering tool telemetry system and then sent via a user interface to the driller at the Earth's surface 51.

Figure 4:
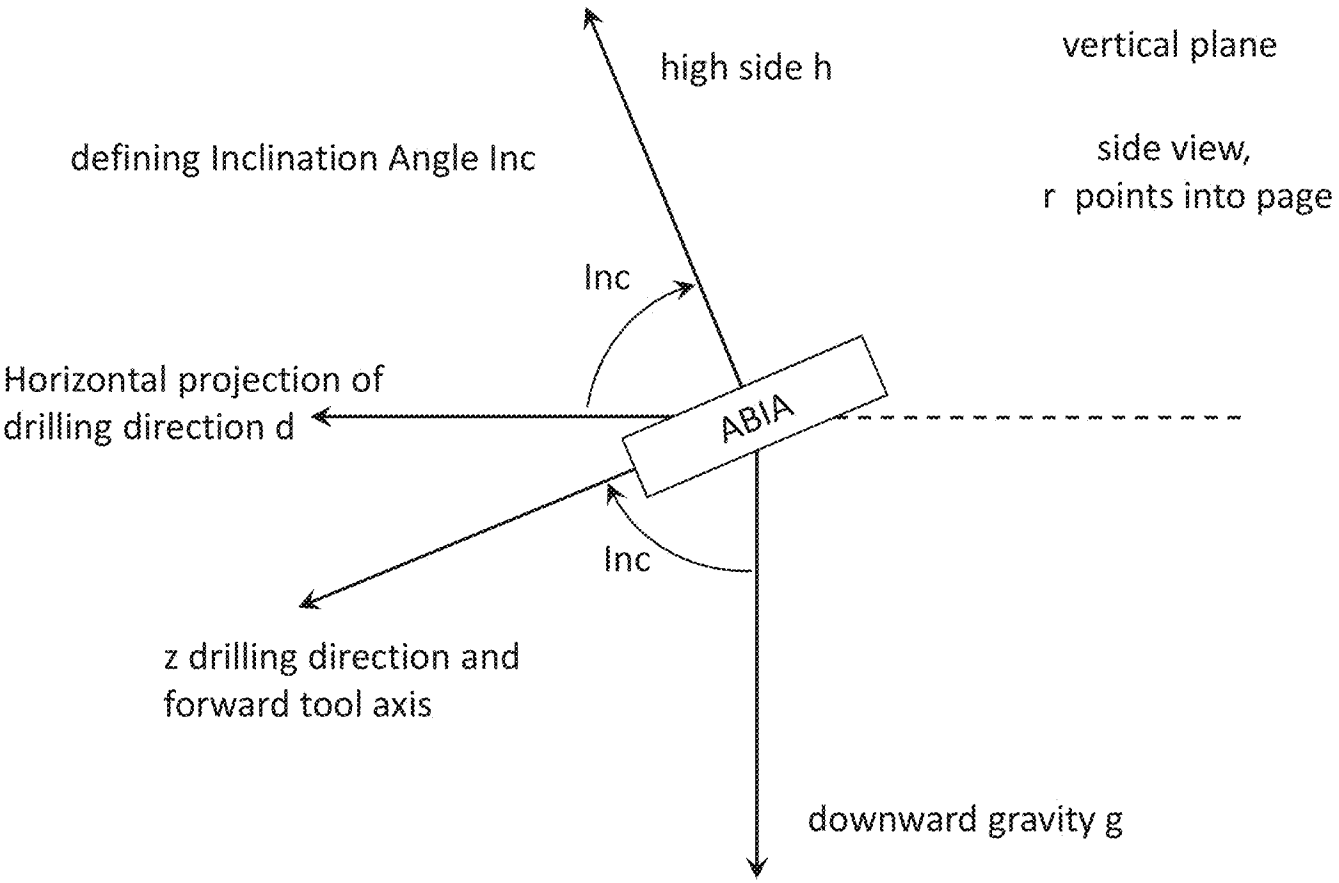
FIG. 4 shows a schematic of the inclination angle Inc, along with some relevant unit vector definitions.

The ABIA tool 8 of an embodiment of the present invention incorporates three calibrated single-axis magnetic field sensors 81 and three single-axis inclinometers 82, which preferably are perpendicular to each other. The sensors 81, 82 report magnetic and gravity field vector components with respect to a right-handed, orthogonal "x-y-z" coordinate system fixed to the tool 8. The z axis is aligned with the forward tool axis as shown in FIG. 4. The inclinometers and magnetometer sensors 82, 81 of the ABIA tool 8 can the same or different type or brand than the accelerometer and magnetometer sensors 34, 35 of the steering tool 52. In disclosing the ABIA tool 8 analysis of this document, the vector and vector function notation are those used by MATLAB. The various coordinate systems disclosed are generated by gravity measurements of the inclinometers.

Figure 5:
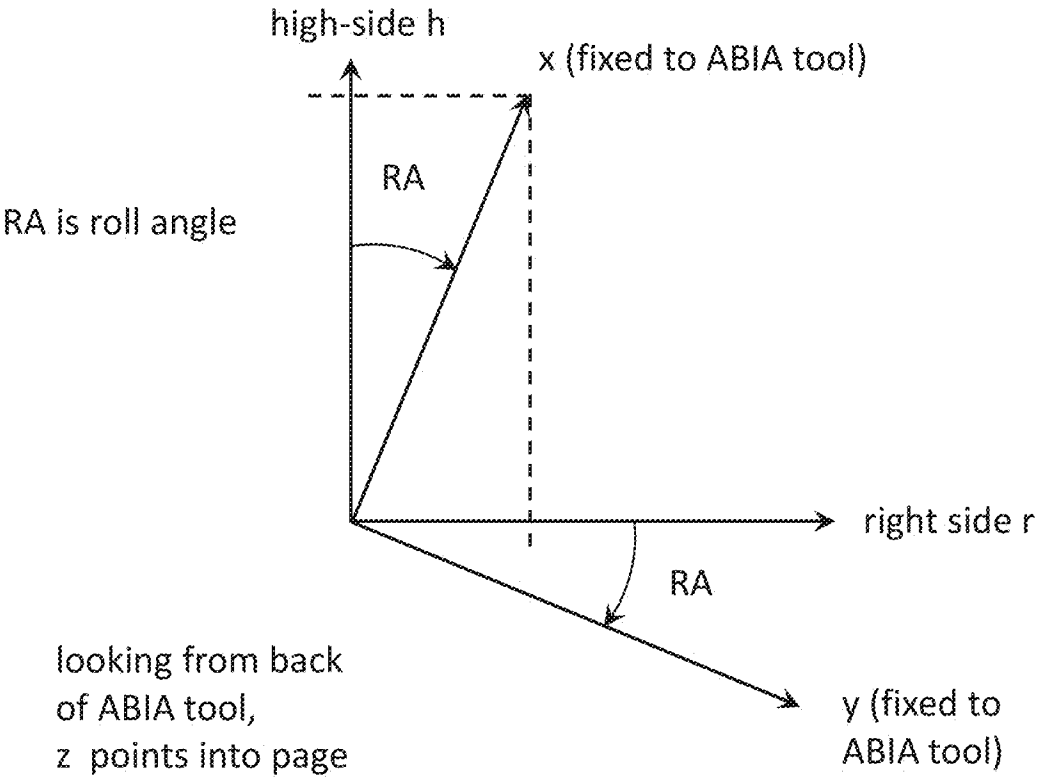
FIG. 5 shows a schematic of a horizontal unit vector r which points to the right of the drilling direction when looking vertically down, given by a vector cross product relationship.
Figure 6:
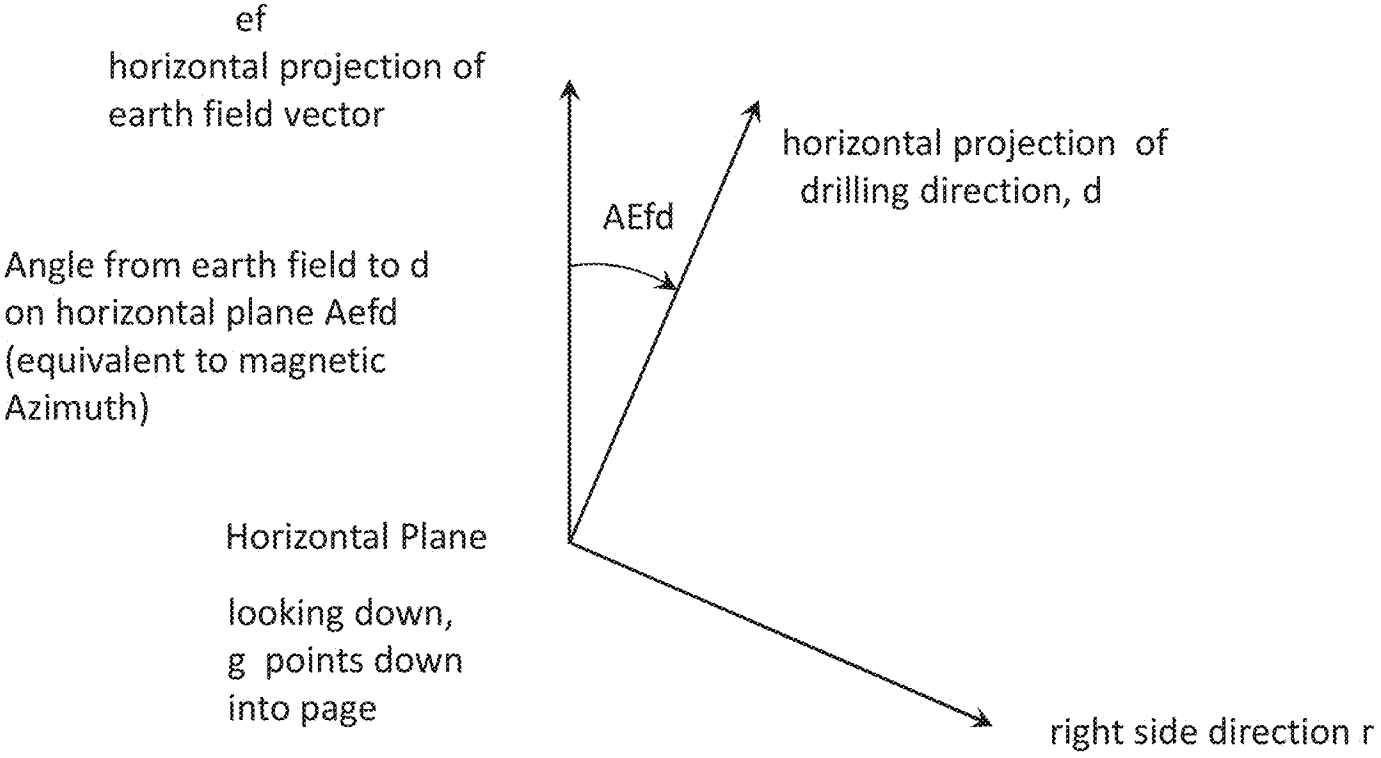
FIG. 6 shows a schematic of the azimuth angle relative to the Earth's magnetic field vector and the horizontal projection of drilling direction d.

FIG. 4-6 illustrate schematically the relationship between several coordinate systems used in the analysis. The unit vectors x, y, and z define an x-y-z coordinate system, unit vectors r, g, and d define an r-g-d system; and unit vectors r, z, and h, a third r-z-h system. Using dot product algebra, the physical quantities of interest are readily expressed in the coordinate system of choice.

Figure 7:
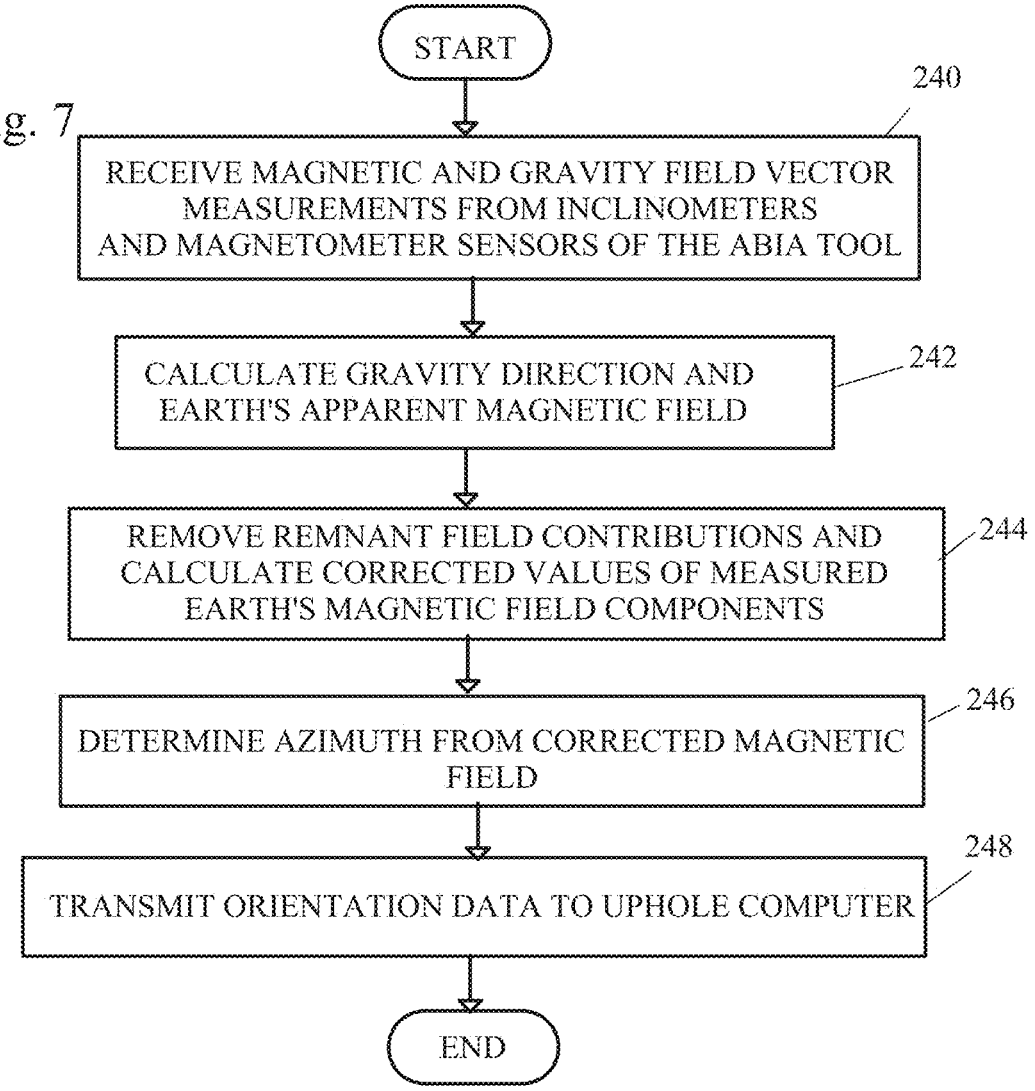
FIG. 7 shows a flow diagram of a method of using the ABIA tool to steer while drilling a borehole.

FIG. 7 shows a flow diagram of a method of using the ABIA tool to steer the drill bit within the borehole along a proposed borehole path 20. The initial steps are essentially identical to those used when a steering tool is used by itself, as is known to those skilled in the art except that there is no consideration of magnetic attenuation or remanent field contributions. While the method below is described relative to the ABIA tool 8, steering measurement could be taken by the steering tool simultaneously, but the Applicant notes that the steering tool measurements are not necessary for the method steps or calculations of FIG. 7 to be completed, other than the data transmission step 248.

In a first step 240, once activated, a processor inside the ABIA tool 8 receives magnetic and gravity field vector component measurements from inclinometers and magnetometers 81, 82 of the ABIA tool 8 behind the drill bit 38.

Next, the processor of the ABIA tool 8 evaluates the magnetic and gravity field vector component measurements of gravity and the Earth's magnetic field through equations 1.1-1.7 discussed below (step 242).

The voltage outputs G of the inclinometers represent the x, y, and z vector components of gravity as shown in FIG. 4. A unit vector g is given by equation 1.1 as $$g=G/\mathrm{norm}(G) \tag{1.1}$$

where:

g is a unit vector pointing in the direction of gravity or "down"

G is the 3-axis accelerometer outputs due to gravity

FIG. 5 shows a horizontal unit vector r which points to the right of the drilling direction looking vertically down and is given by the vector cross product relationship shown in equation 1.2.

$$r=\mathrm{cross}(g,z)/\mathrm{norm}(\mathrm{cross}(g,z)) \tag{1.2}$$

where:

r is the horizontal unit vector in the horizontal plane pointing to the right of the tool g is a unit vector pointing in the direction of gravity z is a unit vector pointing forward along the long axis of the steering tool. z is denoted by [(0;0;1)] in the x-y-z coordinate system.

A horizontal drilling direction vector d is calculated using equation 1.3

$$d=\mathrm{cross}(r,g) \tag{1.3}$$

where:

r is a unit vector in the horizontal plane pointing to the right of the tool g is a unit vector pointing in the direction of gravity.

The horizontal drilling direction unit vector d is a unit vector projection of the drilling axis direction z onto the horizontal plane. A "high side" vector h is perpendicular to the drilling direction z and to the horizontal unit vector r and points generally upwards. The high side vector (see FIG. 4) is calculated using equation 1.4:

$$h=\mathrm{cross}(r,z) \tag{1.4}$$

where:

r is the horizontal unit vector in the horizontal plane pointing to the right of the tool z is a unit vector pointing forward along the long axis of the tool in the direction of drilling. It is denoted by [(0;0;1)] in the x-y-z coordinate system.

The roll angle RA about z (see FIG. 5) is given by equation 1.5 of:

$$RA=\text{atan 2}(\text{dot}(r,x),\text{dot}(h,x)) \tag{1.5}$$

where:

r is a unit vector in the horizontal plane pointing to the right of the tool x is a unit vector fixed to the ABIA and perpendicular to z. It points along the first measurement axis of the magnetometers and inclinometers and is denoted by [(1;0;0)] in the x-y-z coordinate system h is the high side vector.

The inclination (Inc) angle (FIG. 4) of the ABIA tool 8 is given by equation 1.6.

$$\text{Inc}=\text{atan 2}(\text{dot}(z,d),\text{dot}(z,g)) \tag{1.6}$$

where:

z is a unit vector pointing forward along the long axis of the tool g is a unit vector pointing in the direction of gravity d is a drilling direction vector in the horizontal plane.

Vectors expressed in the xyz system can be transformed into their drg representation by multiplying by the matrix xyztodrg $$xyztodrg = \begin{pmatrix} d.x & d.y & d.z \\ r.x & r.y & r.z \\ g.x & g.y & g.z \end{pmatrix} \tag{1.7}$$

with d.x being short for the dot(d, x) function, d.y being short for dot(d, y), and d.z being short for dot(d, z).

Similarly, vectors in the xyz system can be transformed to the hrz system by multiplying by the xyztohrz rotation matrix:

$$xyztohrz = \begin{pmatrix} h.x & h.y & 0 \\ r.x & r.y & 0 \\ 0 & 0 & 1 \end{pmatrix} = \begin{pmatrix} \cos(RA) & -\sin(RA) & 0 \\ \sin(RA)x & \cos(RA) & 0 \\ 0 & 0 & 1 \end{pmatrix} \tag{1.8}$$

where:

RA is the roll angle.

Note that up to this point, only the inclinometer sensor 81 measurement data have been used. Efd and Efr, the measured Earth's magnetic field vector components, are found by applying the transform matrix xyztodrg to the vector Efxyz, the measured magnetic field aligned with the magnetometer axes. The vector r is a unit vector in the horizontal plane pointing to the right of the ABIA tool 8 and d the unit vector pointing along the horizontal projection of the drilling direction vector z. The angle AEfd i.e., the angle from the horizontal projection of the Earth's field to drilling d is given by $$AEfd=\text{atan 2}(-\text{dot}(Ef,r),\text{dot}(Ef,d)) \tag{1.9}$$

The Earth's magnetic north pole is negative magnetically, i.e., the Earth's magnetic field points into the Earth at the magnetic north pole. Thus, AEfd coincides with the conventional definition of Azimuth AZ:

$$AZ=AEfd \tag{2.0}$$

This value of Azimuth measured magnetically differs from the true north azimuth which is the angle from the rotational pole of the Earth to the horizontal projection of drilling direction. Note that Azimuth AZ should not be confused with the z-multiplier Az, which will be introduced below.

It is noted that the calculations up until this point could have been carried out from the inclinometer 34 and magnetometer 35 of the steering tool 52. The gravity and magnetometer measurements of Earth generated magnetic field and gravity can be precise to a few parts per thousand, thus the precision of the measurements can be high.

The calculations described below use the magnetometer sensor 81 measurement data from the ABIA tool 8.

Analyzing measurements made by an ABIA tool directly behind the drill bit to determine bole hole Azimuth involves additional computations. Though the values of gravity and the rotation matrices produced are similar to the steering tool results, the magnetic field vector field components reported by the ABIA tool sensors (magnetometer and inclinometer sensors 81, 82) are likely to be skewed by ferro-magnetic effects, particularly from the tool bit 38. The measured magnetic field components altered by the remanent field Rf generated by the ABIA tool itself, must be subtracted or removed from the measurements by the processor of the ABIA tool (step 244). The apparent Earth field measured, AEf i.e., the field reported by the field measurement Hm is also modified by the ferromagnetic permeability of the ABIA tool 8. The ferromagnetic permeability has the effect of multiplying each component of the Earth's magnetic field reported by the ABIA tool 8.

The apparent Earth field AEf, i.e. the effect of the Earth's magnetic field Ef on the ABIA magnetometers 81, is to attenuate or amplify them by multiplying by a diagonal Ax, Ay, Az matrix:

$$AEfxyz = \begin{bmatrix} Ax & 0 & 0 \\ 0 & Ay & 0 \\ 0 & 0 & Az \end{bmatrix} * Efxyz \tag{2.1}$$

where:

Ax, Ay and Az are multipliers for the x, y and z magnetic field components.

The matrix is diagonal because the x, y, and z directions are symmetry axes for the ABIA tool 8 structure and the x & y magnetometer outputs are similar, making Ax and Ay equal to a "perpendicular-to-z" multiplier Ap. The net magnetic signal generated by the ABIA tool is:

$$Hmxyz = AEfxyz + Rfxyz = \begin{bmatrix} Ax & 0 & 0 \\ 0 & Ay & 0 \\ 0 & 0 & Az \end{bmatrix} * Efxyz + Rfxyz \tag{2.2}$$

Rfxyz is the vector representing the offsets introduced due to the remanent magnetic field components generated by the ABIA tool structure including the the drill bit and surrounding steel. In general, one would not expect a newly-manufactured component to contain a magnetic field; however, over time it is possible for components, especially drill bits, to become slightly magnetized. Efxyz can be expressed in its drg representation, i.e., $$Hmxyz = \begin{bmatrix} Ax & 0 & 0 \\ 0 & Ay & 0 \\ 0 & 0 & Az \end{bmatrix} * drgtoxyz * Efdrg + Rfxyz \tag{2.3}$$

Solving for Efdrg in (2.3) yields (2.4)

$$Efdrg = xyztodrg * \begin{bmatrix} 1/Ax & 0 & 0 \\ 0 & 1/Ay & 0 \\ 0 & 0 & 1/Az \end{bmatrix} * (Hmxyz - Rfxyz) \tag{2.4}$$

The processor of the ABIA tool 8 then determines a corrected azimuth from the corrected magnetic field (step 246). Finally the ABIA-derived azimuth of drilling becomes $$AZABIA = \text{atan } 2(-Efdrg(2), Efdrg(1)) \tag{2.5}$$

The corrected values of the azimuth and the magnetic and gravity field vector measurements from the ABIA tool 8 are transmitted to the uphole computer 114 by a processor of the steering tool 52 via the telemetry wire 110 (step 248) and the method ends.

It is noted that while the above method was described as being carried out by the processor of the ABIA tool 8, alternatively, only step 240 would be handled by the ABIA tool 8, and the remaining steps of the method are executed by a processor of the steering tool 52 or the uphole computer 114. If the ABIA tool 8 carries out the calculations, the steering tool 52 receives the inclination and azimuth results as described above.

If a processor of the steering tool 52 executes the calculations, the ABIA tool 8 sends the azimuth and the magnetic and gravity field vector measurements to the steering tool 52 and the steering tool executes steps 242-246, with the calculation results being sent to the uphole computer 114 by a processor of the steering tool 52 via the telemetry wire 110.

If the uphole computer 114 executes the calculations, the ABIA tool 8 sends the azimuth and the magnetic and gravity field vector measurements to the steering tool 52 and the steering tool 52 sends the magnetic and gravity field vector measurements to the uphole computer 114 by a processor of the steering tool 52 via the telemetry wire 110, with steps 242-246 of the method being executed by the uphole computer 114 and step 248 is not carried out.

Figure 8:
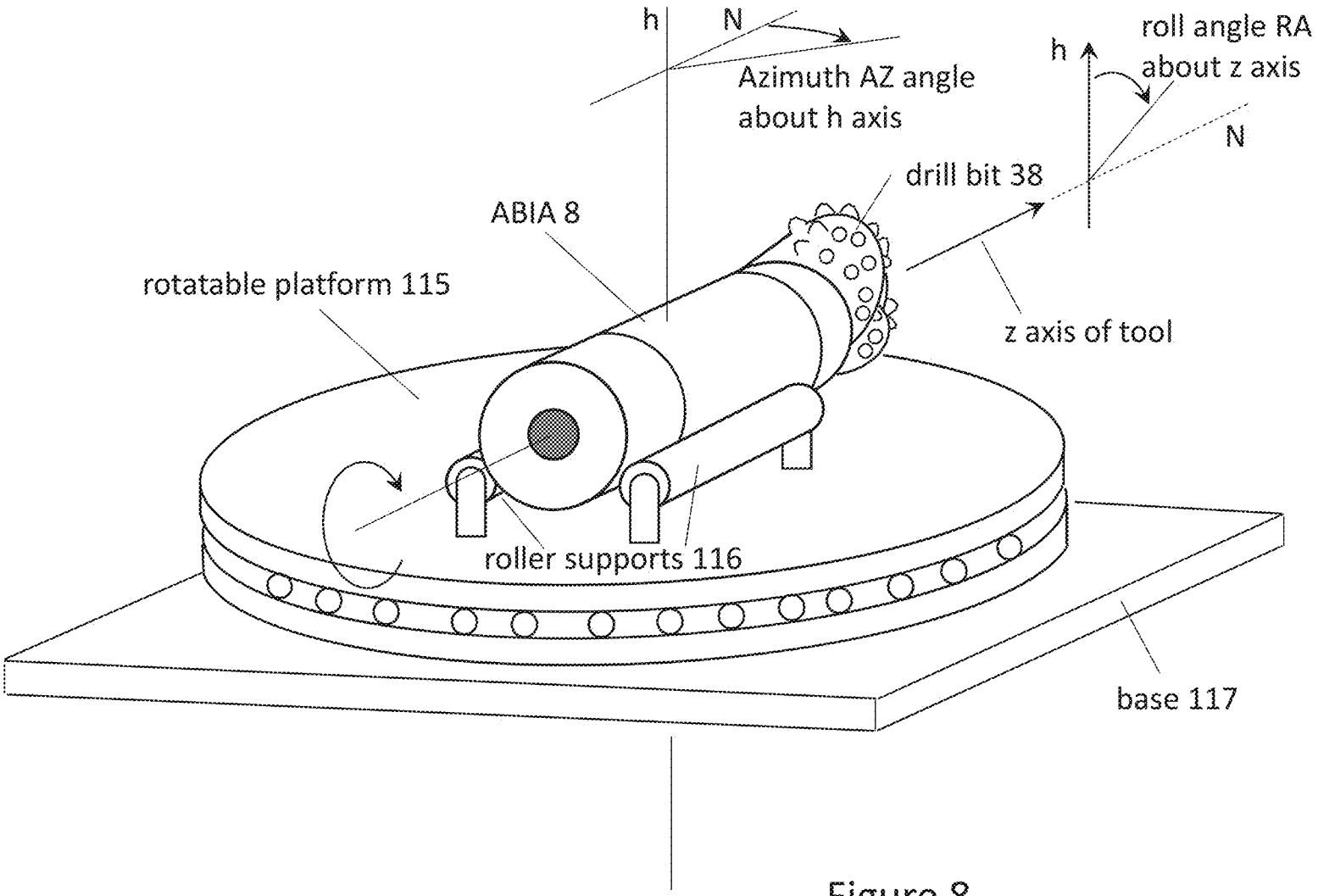
FIG. 8 shows a turntable apparatus for calibrating an ABIA tool, particularly the z components, at the Earth's surface.

Regardless of the above details, to obtain the corrected Azimuth result it is necessary to calibrate the ABIA tool 8, i.e., to find Ax, Ay, and Az, and Rfx, Rfy and Rfz which characterize how the magnetic field behaves locally around the ABIA tool 8. FIG. 8 shows a turntable apparatus or rotatable platform 115 for calibrating the ABIA tool 8 and associated drill bit 38. The turntable apparatus is set 115 on top of or integrally formed with a base 117. The base 117 can be tiltable such that it can be leveled. The turntable apparatus 115 allows for rotation about the high side vector h. The base 117, the rotatable platform 115 and the roller supports 116 are all nonmagnetic. The ABIA tool 8 is supported atop the turntable apparatus 115 by roller supports 116 which allows for rotation of the ABIA tool 8 about the z axis of the ABIA tool 8.

Figure 9:
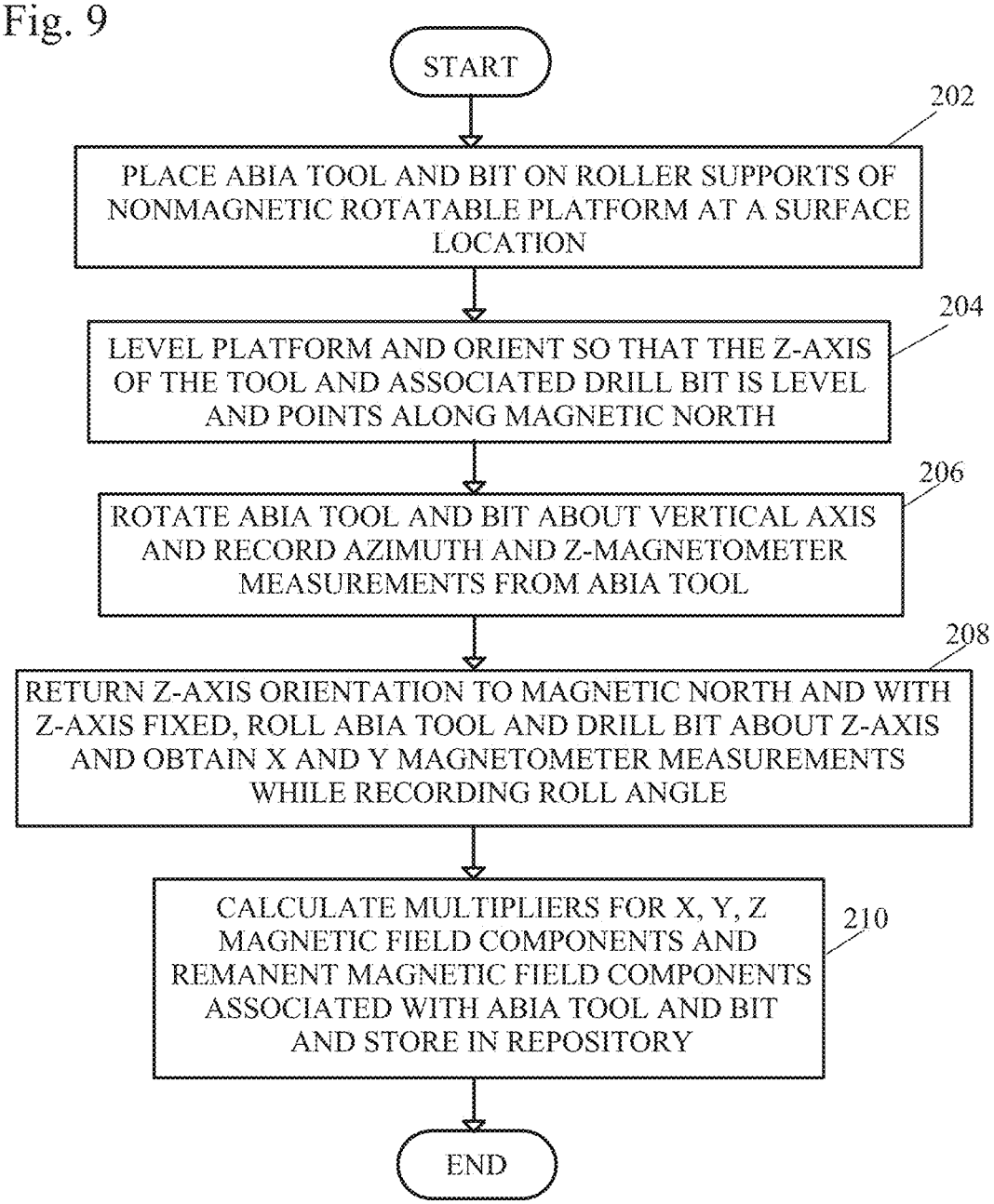
FIG. 9 shows a flow diagram of a method of obtaining a complete set of calibration parameters for the ABIA tool using the apparatus of FIG. 8 up-hole.

FIG. 9 shows a flow diagram of a method of up-hole calibration procedure of the ABIA tool 8 using the turntable apparatus 115 and associated calibrating stand 117 of FIG. 8. It is noted that prior to the method of FIG. 9, steering tool magnetometers 35 are used to measure the Earth field values Efxy at the calibration site before setting the ABIA tool 8 on the turntable apparatus 115.

In a first step (step 202), the ABIA tool 8 and drill bit 38 are placed on roller supports 116 of the rotatable platform 115 at an above surface location, for example near borehole entry point 24. The rotatable platform 115 is leveled and rotated such that the z-axis of the ABIA tool 8 points magnetically north (step 204). North can be found from steering tool data made at the calibration site prior to the start of the method.

The ABIA tool 8 and associated drill bit 38 are rotated about a vertical axis and the measurements in the z-direction from the magnetometer sensor 81 of the ABIA tool 8 and the azimuth (AZ) are stored in a repository (step 206).

Next, the z-axis of the ABIA tool 8 is reset or determined to be set to magnetic North. With the z-axis fixed, the ABIA tool 8 is rolled about the z-axis to obtain x and y magnetometer sensor 81 measurements and the associated roll angle (RA) and the measurements are stored in the repository (step 208).

Multipliers (Ax, Ay, Az) for x, y, z magnetic field components and remanent magnetic field components associated with the ABIA tool 8 and the drill bit 38 are calculated (step 210) and the method ends. The calculation of the multiplier is carried out using equations 2.6-2.96 discussed below.

The unit vector e, pointing east, is found from the steering tool measurements by $$e = \frac{\text{cross}(g, Ef)}{norm(\text{cross}(g, Ef))} \tag{2.6}$$

A unit vector in the north direction n is given by $$n = \text{cross}(e, g) \tag{2.7}$$

The z component magnetometer fields Hmz(i) reported by the by the z magnetometer sensor 81 reported for Azimuth settings AZ(i)=AZ(1):AZ(N) of the rotatable platform 115 can be written $$HMz = \begin{bmatrix} Hmz(1) \\ \cdot \\ \cdot \\ Hmz(i) \\ \cdot \\ \cdot \\ Hmz(N) \end{bmatrix} = \begin{bmatrix} \cos(AZ(1)) & 1 \\ \cdot & \cdot \\ \cdot & \cdot \\ \cos(AZ(i)) & 1 \\ \cdot & \cdot \\ \cdot & \cdot \\ \cos(AZ(N)) & 1 \end{bmatrix} * \begin{bmatrix} Az * Efz \\ Rfz \end{bmatrix} \tag{2.8}$$

wherein:

HMz is the z component magnetometer measurement

Az is a multiplier of the z magnetic field component

Efz is Earth's magnetic field along the z axis

Rfz is the remnant field in the z direction

AZ is the Azimuth angle

Defining $$DMz = \begin{bmatrix} \cos(AZ(1)) & 1 \\ \cdot & \cdot \\ \cdot & \cdot \\ \cos(AZ(i)) & 1 \\ \cdot & \cdot \\ \cdot & \cdot \\ \cos(AZ(N)) & 1 \end{bmatrix} \tag{2.81}$$

$$ERz = \begin{bmatrix} Az * Efz \\ Rfz \end{bmatrix} \tag{2.82}$$

Wherein:

DMz is a matrix with the cosine of the Azimuth angles in the first column

ERz is a vector of calibration parameters for the z axis
Az is a multiplier of the z magnetic field component
Efz is Earth's magnetic field along the z axis
Rfz is the remnant field in the z direction
AZ is the Azimuth angle
HMz can be written $$HMz=DMz*ERz \tag{2.83}$$

Solving for ERz gives $$ERz=(DMz'*DMz)\backslash DMz'*HMz \tag{2.84}$$

Finally, the field multiplier Az and the offset Rfz are $$Az=ERz(1)/Efz \tag{2.85}$$

and $$Rfz=ERz(2) \tag{2.86}$$

This procedure can also be applied to finding the x and y parameters Ax, Ay and Rfx and Rfy by rolling the ABIA tool 8 on the rotatable stand 115 of FIG. 8 with the ABIA tool 8 axis pointing horizontally and magnetically north (step 208). Note that in this case the x and y axes react only to Efh because the right-side earth field component Efr=0 and Efz is perpendicular to the x and y ABIA axes. Focusing first on HMx and measuring an ensemble of various roll angles which are being measured by the ABIA inclinometers 82; the following matrices are generated:

$$HMx=\begin{bmatrix} Hmx(1) \\ \cdot \\ \cdot \\ Hmx(i) \\ \cdot \\ \cdot \\ Hmx(N) \end{bmatrix}=\begin{bmatrix} \cos(RA(1)) & 1 \\ \cdot & \cdot \\ \cdot & \cdot \\ \cos(RA(i)) & 1 \\ \cdot & \cdot \\ \cdot & \cdot \\ \cos(RA(N)) & 1 \end{bmatrix}*\begin{bmatrix} Ax*Efh \\ Rfx \end{bmatrix} \tag{2.87}$$

$$DMx=\begin{bmatrix} \cos(RA(1)) & 1 \\ \cdot & \cdot \\ \cdot & \cdot \\ \cos(RA(i)) & 1 \\ \cdot & \cdot \\ \cdot & \cdot \\ \cos(RA(N)) & 1 \end{bmatrix} \tag{2.88}$$

Wherein:
HMx are the x-component magnetometer measurements
Ax is a multiplier of the x magnetic field component
Efh is Earth's magnetic field in the high side direction
Rfx is is the remnant field in the x direction
RA is the Roll angle
The solution of this set for ERx is $$ERx=\begin{bmatrix} Ax*Efh \\ Rfx \end{bmatrix}=(DMx'*DMx)\backslash DMx'*HMx \tag{2.89}$$

$$Ax=ERx(1)/Efh \tag{2.90}$$

$$Rfx=ERx(2) \tag{2.91}$$

where:
ERx is a vector of calibration parameters for the x axis
DMx is a matrix with the cosine of the roll angles in the first column
Ax is a multiplier of the x magnetic field component
Efh is Earth's magnetic field in the high side direction
Rfx is is the remnant field in the x direction
Finally, for the Hmy component $$HMy=\begin{bmatrix} Hmy(1) \\ \cdot \\ \cdot \\ Hmy(i) \\ \cdot \\ \cdot \\ Hmy(N) \end{bmatrix}=\begin{bmatrix} -\sin(RA(1)) & 1 \\ \cdot & \cdot \\ \cdot & \cdot \\ -\sin(RA(i)) & 1 \\ \cdot & \cdot \\ \cdot & \cdot \\ -\sin(RA(N)) & 1 \end{bmatrix}*\begin{bmatrix} Ay*Efh \\ Rfy \end{bmatrix} \tag{2.92}$$

$$DMy=\begin{bmatrix} -\sin(RA(1)) & 1 \\ \cdot & \cdot \\ \cdot & \cdot \\ -\sin(RA(i)) & 1 \\ \cdot & \cdot \\ \cdot & \cdot \\ -\sin(RA(N)) & 1 \end{bmatrix} \tag{2.93}$$

$$ERy=\begin{bmatrix} Ay*Efh \\ Rfy \end{bmatrix}=(DMy'*DMy)\backslash DMy'*HMy \tag{2.94}$$

$$Ay=ERy(1)/Efh \tag{2.95}$$

$$Rfy=ERy(2) \tag{2.96}$$

where:
DMy is matrix with the negative sine of the roll angles in the first column
ERy is a vector of calibration parameters for the y axis
Ay is a multiplier of the y magnetic field component
Efh is Earth's magnetic field in the high side direction
Rfy is is the remnant field in the x direction
RA is the Roll angle The purpose of the ABIA tool 8 is to recognize the difference in Azimuth between sequential survey drilling locations to recognize unexpected drilling direction changes sooner than would be possible with a steering tool 52 by itself. For doing this, the above disclosed analysis assuming a symmetric ABIA tool 8 may be adequate. More precise calibration factors are readily found from these data by iteration, i.e., using the calibration results of the method outlined and redoing the analysis of the measurements made using these values.

Figure 10:
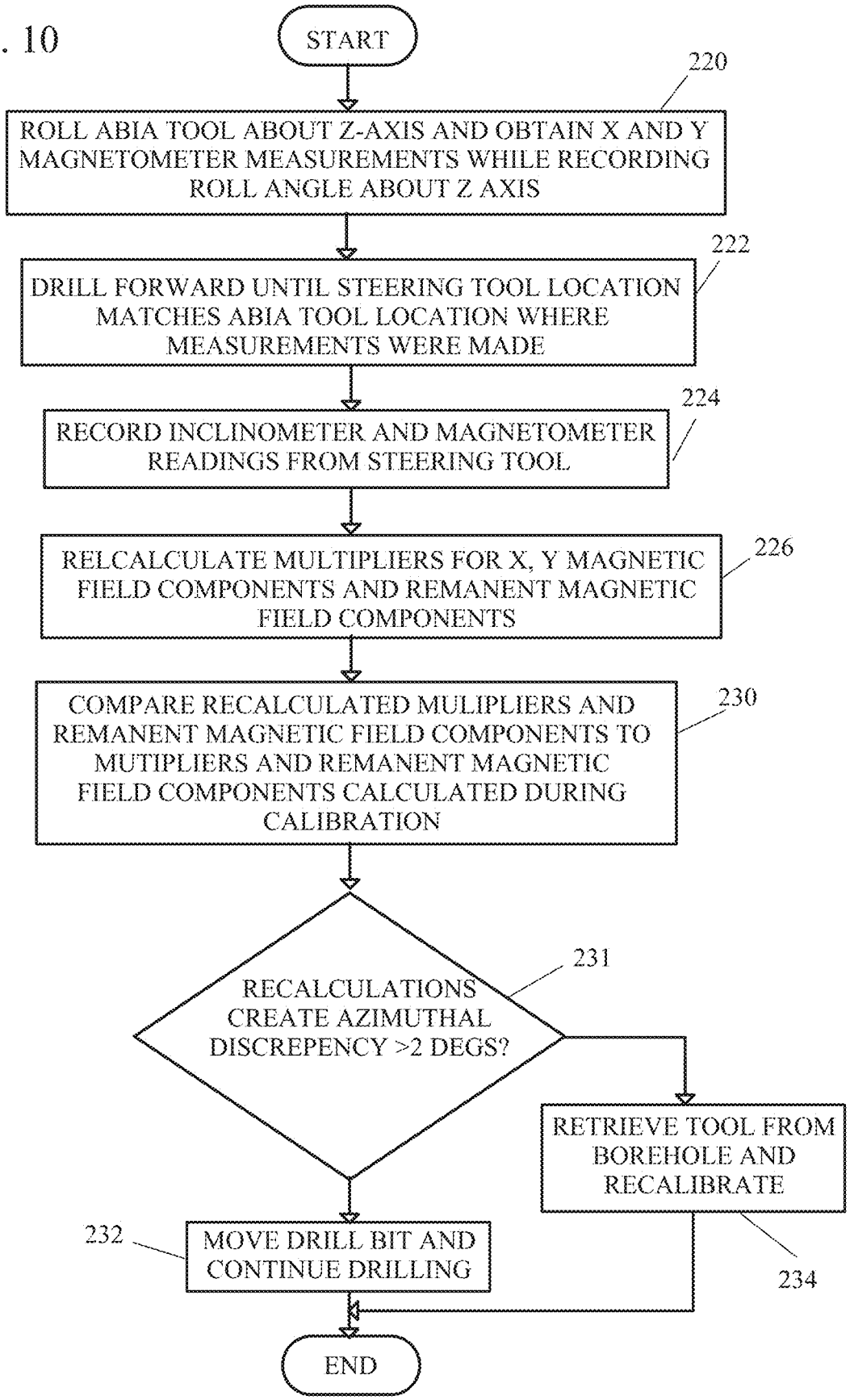
FIG. 10 shows a flow diagram of a method of checking and/or recalculating ABIA x and y calibration parameters Ax, Ay, Rfx, Rfy while the ABIA tool is downhole.

The remanent field calibration parameters Rfx, Rfy and the tool gain factors Ap=Ax=Ay can be confirmed and/or recalculated while drilling the borehole using the method disclosed in FIG. 10. It is noted that the method of FIG. 10 is optional and may be used during the drilling of certain jobs.

To begin the procedure, drilling is halted and the drilling assembly 42 is pulled within the borehole being drilled 12 and towards the Earth's surface and the borehole entry point 24 so that the ABIA tool 8 is moved to a designated position. The designated position is set to be the last position in which the steering tool 52 was positioned during drilling and readings/measurements were obtained, such as the Earth's vector magnetic field Efdrz using the steering tool magnetic field and gravity measurements. Holding the main drill string 36 fixed, the ABIA tool 8 is rotated and measurements are made including ABIA roll angles RA within the borehole being drilled 12. Alternatively, the ABIA readings can be taken and saved during the drilling process until the steering tool advances to the location where the ABIA measurements were taken (as described in FIG. 10). In either case, holding the main drill string 36 fixed, the ABIA is rotated and measurements are made at an ensemble of ABIA roll angles RA. Analysis of the resulting Hmxyz and Efdrz from the same location results in a method of calibration giving the ABIA x-y gain factor Ap and the Rfx and Rfy field offset values.

The remanent field x & y field components can be determined at any depth and drilling motor roll angle. These remanent magnetic field components Rfx and Rfy are subtracted or removed from the Hmx and Hmy vector components and the updated values of AEfx and AEfy are then corrected comparing measurements made with the steering tool sensors 34, 35 at the same location while free of permeability effects to yield adjusted calibration factors Ax Ay Rfx Rfy.

The method of FIG. 10 can be executed at various points during the drilling of the bore hole, to allow for periodic updates. For example, it is possible that the drill bit can become magnetized by surrounding rock and/or change its magnetic signature due to heating and thus affect the Azimuth calculations.

In a first step (step 220), the ABIA tool 8 is rolled about the z-axis and x and y measurements from the magnetometer are recorded along with a roll angle within the borehole. Drilling continues until the steering tool location matches the borehole location where the ABIA measurements were previously taken (step 222). Inclinometer and magnetometer readings from the steering tool 52 are recorded and stored in a repository (step 224). Calibration factors Ax Ay Rfx Rfy are then re-calculated (step 226) as follows.

Consider the voltage output of the x component sensor of the ABIA measured field vector, Hmx, made with roll angle RA at a borehole location where Efdrz was determined by steering tool data.

$$Hmx = dot(H, x) \tag{3.0}$$

$$= AEfh * dot(h, x) + AEfr * dot(r, x) + Rfx \tag{3.1}$$

$$= AEfh * \cos(RA) + AEfr * \sin(RA) + Rfx \tag{3.2}$$

where:

Hmx is the field x-component measured with roll angle RA h is a high side unit vector as defined previously x is a unit vector fixed to the ABIA, aligned with sensors as described previously r is the right side unit vector as defined previously AEfh is the apparent value of the Earth's magnetic field in the h direction AEfr is the apparent value of the Earth's magnetic field in the r direction RA is roll angle Rfx is the remanent magnetic field of the ABIA and bit in the x direction Assuming that the matrices $$\begin{bmatrix} Ax & 0 & 0 \\ 0 & Ay & 0 \\ 0 & 0 & Az \end{bmatrix}$$

& hrztoxyz commute, Hmx can be written in matrix form as shown in equation (3.3):

$$Hmx = [\cos(RA) \quad \sin(RA) \quad 1] * \begin{bmatrix} AEfh \\ AEfr \\ Rfx \end{bmatrix} \tag{3.3}$$

These matrices do commute if Ax=Ay=Ap, which is usually the case.

An ensemble of N such measurements at a set of random roll angles RA, at a fixed depth, by rotating the ABIA tool 8 are assembled into a matrix of the form as shown below. The values of Efh and Efr are taken from previous Earth field evaluation by the steering tool 52 at the same borehole depth. Ap is the field gain/attenuation factor for Earth field components perpendicular to the drilling direction. Noting that Ax=Ay=Ap, the results of an ensemble of measurements at location where Efh is known can be written $$HMx = \begin{bmatrix} Hmx(1) \\ \cdot \\ \cdot \\ Hmx(i) \\ \cdot \\ \cdot \\ Hmx(N) \end{bmatrix} = \begin{bmatrix} \cos(RA(1)) & \sin(RA(1)) & 1 \\ \cdot & \cdot & \cdot \\ \cdot & \cdot & \cdot \\ \cos(RA(i)) & \sin(RA(i)) & 1 \\ \cdot & \cdot & \cdot \\ \cdot & \cdot & \cdot \\ \cos(RA(N)) & \sin(RA(N)) & 1 \end{bmatrix} * \begin{bmatrix} Ap * Efh \\ Ap * Efr \\ Rfx \end{bmatrix} \tag{3.4}$$

Wherein:

RA is roll angle

Ap is the perpendicular multiplier of the x and y magnetic field components

Rfx is the remanent magnetic field of the ABIA and bit in the x direction

Efh is Earth's magnetic field in the high side direction

Efh is Earth's magnetic field in the right side direction

HMx is a list of x-magnetometer measurements

Defining $$DMx = \begin{bmatrix} \cos(RA(1)) & \sin(RA(1)) & 1 \\ \cdot & \cdot & \cdot \\ \cdot & \cdot & \cdot \\ \cos(RA(i)) & \sin(RA(i)) & 1 \\ \cdot & \cdot & \cdot \\ \cdot & \cdot & \cdot \\ \cos(RA(N)) & \sin(RA(N)) & 1 \end{bmatrix} \tag{3.5}$$

and $$ERx = \begin{bmatrix} Ap * Efh \\ Ap * Efr \\ Rfx \end{bmatrix} \tag{3.6}$$

The above equations 3.5 and 3.6 can be written as equation 3.7

$$HMx = DMx * ERx \tag{3.7}$$

where:

HMx is a list of x-magnetometer measurements

DMx is a design matrix relating HMx to h and r directions for different roll angles.

ERx is a vector of calibration parameters including the x component of remanent field Rfx.

The least squares method can be used to solve for ERx $$ERx = \begin{bmatrix} Ap*Efh \\ Ap*Efr \\ Rfx \end{bmatrix} = (DMx' * DMx)\backslash(DMx' * HMx) \tag{3.8}$$

Since Efh and Efr are known, two determinations of Ap result, checking the consistency of the assumptions.

$$Ap=ERx(1)/Efh \tag{3.9}$$

$$Ap=ERx(2)/Efr \tag{3.91}$$

$$Rfx=ERx(3) \tag{3.92}$$

ERx has three components: the apparent Earth high side AEfh multiplier and the apparent right or horizontal side AEfr multiplier at the depth of the measurements and the x component of the remanent field Rfx of the ABIA tool 8. The remanent field Rfx and Ap are ABIA tool 8 properties and are the same no matter what the Earth's field at the measuring site happens to be.

The same method can be used to solve for a vector to find ERy with appropriate change in the parameters $$ERy=(DMy'*DMy)\backslash(DMy'*HMy) \tag{4.0}$$

where:

ERy is a vector of correction factors and the y component of remanent field Rfy

DMy is a design matrix relating HMy to h and r directions for different roll angles HMy is a list of y-magnetometer measurements Note that since DMx, DMy are essentially rotation matrices, the structure of DMy looks slightly different than DMx, i.e.

$$DMy = \begin{bmatrix} -\sin(RA(1)) & \cos(RA(1)) & 1 \\ . & . & . \\ . & . & . \\ -\sin(RA(i)) & \cos(RA(i)) & 1 \\ . & . & . \\ . & . & . \\ -\sin(RA(N)) & \cos(RA(N)) & 1 \end{bmatrix} \tag{4.1}$$

The same procedure is applied to the observed y projections of H i.e., Hy, using the appropriate design matrix DMy in place of DMx, Similarly, ERy has three components the apparent Earth high side AEfh and the apparent right or horizontal side AEfr at the depth of the measurements and the y component of the remanent field Rfy of the ABIA tool 8 in equation 4.2:

$$Rfy=ERy(3) \tag{4.2}$$

After the recalculation step, the recalculated multipliers for the x magnetic field component, y magnetic field component and remanent field components are compared to the multipliers for the x magnetic field component, y magnetic field component and remanent field components calculated during calibration (step 230).

If the recalculated multipliers for the x magnetic field component, y magnetic field component and remanent field components would create an azimuth discrepancy of greater than 2 degrees (step 231), the ABIA tool 8 is retrieved from the borehole for recalibration (step 234) and the method ends. If recalibration is required, a user places the ABIA tool 8 on the rotatable platform 115 and the method of FIG. 9 is repeated above ground.

If the recalculated multipliers for the x magnetic field component, y magnetic field component and remanent field components create an azimuth discrepancy of less than 2 degrees (step 231), the ABIA tool 8 and drill bit remain in place and drilling continues at current measurements (step 232) and the method ends.

Example Calculation:

The following example, although idealized, may be illustrative. For simplicity, assume that the borehole is approximately horizontal so that the Roll Angle RA can be determined by the values of the x and y inclinometer readings. The driller activates the drilling motor in short increments so that the bent sub, ABIA tool, and drill bit all rotate 45 degrees per increment. Ideal readings are obtained as follows:

| Inc X (g) | Inc Y (g) | RA (deg) | Mag X (nT) | Mag Y (nT) |
|---|---|---|---|---|
| −1.0 | 0 | 0 | 42200 | 5200 |
| −0.71 | 0.71 | 45 | −34456 | 33638 |
| 0 | 1.0 | 90 | 8200 | 41200 |
| 0.71 | 0.71 | 135 | 36638 | 23456 |
| 1.0 | 0 | 180 | 44200 | −9200 |
| 0.71 | −0.71 | 225 | 26456 | −37638 |
| 0 | −1.0 | 270 | −6200 | −45200 |
| −0.71 | −0.71 | 315 | −34638 | −247456 |

Some time later, with the steering tool in the same borehole position, magnetic readings from the steering tool show Efh=−48000 nT and Efr=8000 nT. Assuming the ABIA readings are skewed and the steering tool readings are accurate, we form the matrices $$HMx = \begin{bmatrix} 42200 \\ -24456 \\ 8200 \\ 36638 \\ 44200 \\ 26456 \\ -6200 \\ -34638 \end{bmatrix}$$

$$DMx = \begin{bmatrix} 1 & 0 & 1 \\ 0.7071 & 0.7071 & 1 \\ 0 & 1 & 1 \\ -0.7071 & 0.7071 & 1 \\ -1 & 0 & 1 \\ -0.7071 & -0.7071 & 1 \\ 0 & -1 & 1 \\ 0.7071 & 0.7071 & 1 \end{bmatrix}$$

Solving for ERx we obtain $$ERx = (DMx' * DMx)\backslash(DMx' * HMx) = \begin{bmatrix} -43200 \\ 7200 \\ 1000 \end{bmatrix}$$

Since we know that $$ERx = \begin{bmatrix} Ap * Efh \\ Ap * Efr \\ Rfx \end{bmatrix}$$

And we measured Efh and Efr with the steering tool, so we calculate $$Ap = ERx(1)/Efh = -43200/-48000 = 0.9$$

A parallel calculation is expected to produce a similar estimate for Ap $$Ap = ERx(2)/Efr = 7200/8000 = 0.9$$

And the remanent magnetic field in the x direction associated with the ABIA tool and drill bit is $$Rfx = ERx(3) = 1000nT.$$

A similar idealized calculation for the y components yields Ap=0.9 and Rfy=−2000 nT.

To determine if the parameters have drifted significantly, one would compare the results of equations as calculated with Ap, Rfx, Rfy to the results obtained with previously calculated parameters. If the calculated Azimuths vary by less than two degrees, the discrepancy is tolerable and drilling can continue. If the discrepancy is much larger than 2 degrees, the driller should consider a complete surface recalibration.

The two degree threshold is somewhat arbitrary but is comparable to the bent sub angle, which can create a small discrepancy in the calculated azimuth or inclination between the ABIA tool and steering tool, depending on the ABIA tool orientation during measurement. A discrepancy that is larger than the bent sub angle, however, indicates that the calibration parameters have likely changed.

In one embodiment, the calibration of the ABIA tool of FIG. 9 is the only method executed to maintain accurate drilling within the borehole. The calibration may be repeated each time the entire drill assembly is removed from the borehole being drilled, but it is not repeated every 10-15 meters of drilling.

In an alternate embodiment, after the calibration of the ABIA tool (see FIG. 9), the calibration can be checked using the method of FIG. 10 at specific intervals during drilling of the borehole with the drilling assembly within the borehole being drilled.

Conventional bore hole tracking often employs an alternating magnetic field generated by AC current in a nearby wire loop or beacon solenoid whose location coordinates and electric current are carefully measured. The use of an ABIA tool in the AC application is like that in the above disclosure except that the analysis is simplified by the fact that the remanent field of the ABIA tool need not be subtracted from the measurements (because the surrounding steel cannot contain a remnant AC field). The AC attenuation factors could be calculated in a manner similar to the DC factors. During drilling, additional calculations may provide position information based on a model of the AC current source as in U.S. Pat. No. 6,466,020. The magnetic field being evaluated may also be generated by direct current (DC) in some specialized situations.

Accordingly, it is to be understood that the embodiments of the invention herein described are merely illustrative of the application of the principles of the invention. Reference herein to details of the illustrated embodiments is not intended to limit the scope of the claims to be filed in a utility patent application claiming benefit of this provisional application, which themselves will recite those features regarded as essential to the invention.

What is claimed is:

1. A downhole drilling assembly comprising:

a first proximal end and a second distal end;

a rotatable drill bit positioned at the second distal end of the assembly;

an at bit inclination and azimuth tool positioned immediately proximate and connected to the rotatable drill bit, wherein the at bit inclination and azimuth tool comprises a three axis at bit inclination and azimuth tool inclinometer sensor, and a solenoidal alternating current magnetic coil, wherein the three axis at bit inclination and azimuth tool inclinometer sensor is configured to gather information related to an angular position of the rotatable drill bit;

a bent sub proximally positioned and connected to the at bit inclination and azimuth tool;

a downhole motor proximally positioned and coupled to the bent sub for rotating the drill bit;

a steering tool proximally positioned to the downhole motor and having a three axis steering tool magnetometer sensor and a three axis steering tool inclinometer sensor connected to a communication device; and a drill string connected to the downhole motor and receiving the steering tool;

wherein the solenoidal alternating current magnetic coil of the at bit inclination and azimuth tool is structured, configured or positioned to communicate the information related to the angular position of the rotatable drill bit gathered by the three axis at bit inclination and azimuth tool inclinometer sensor of the at bit inclination and azimuth tool to a processor of the steering tool, and the communication device is structured, configured or positioned to communicate the information from the processor of the steering tool to a processor positioned at the first proximal end of the assembly.

2. The downhole drilling assembly of claim 1, wherein the at bit inclination and azimuth tool further comprises a three axis at bit inclination and azimuth tool magnetometer sensor.

3. The downhole drilling assembly of claim 2, wherein the three-axis at bit inclination and azimuth tool inclinometer sensor is perpendicular to the three axis at bit inclination and azimuth tool magnetometer sensor.

4. The downhole drilling assembly of claim 2, wherein the assembly further comprises: a hollow nonmagnetic housing having a first end connected to the drill bit and a second end connected to the bent sub; a sealed central drill fluid tube received within the hollow nonmagnetic housing and connected to the drill bit and the downhole motor via the bent sub; and a battery pack.

5. The downhole drilling assembly of claim 4, wherein the three axis at bit inclination and azimuth tool inclinometer sensors is positioned within the hollow nonmagnetic housing and the three axis at bit inclination and azimuth tool magnetometer sensors is positioned within the hollow nonmagnetic housing surround the sealed central drill fluid tube.

6. The downhole drilling assembly of claim 2, wherein the three axis at bit inclination and azimuth tool inclinometer sensors and the three axis at bit inclination and azimuth tool magnetometer sensors measure magnetic and gravity field vector components with respect to an x-y-z coordinate system fixed to the at bit inclination and azimuth tool.

7. The downhole drilling assembly of claim 1, wherein the communication device is a telemetry wire.

8. A method of calibrating an at bit inclination and azimuth tool connected to a rotatable drill bit of a downhole drilling assembly, the method comprising:

placing the at bit inclination and azimuth tool connected to the rotatable drill bit on roller supports connected to a rotatable platform at a borehole site;

leveling the rotatable platform such that a z-axis of the at bit inclination and azimuth tool and rotatable drill bit is level and points along magnetic north;

rotating the at bit inclination and azimuth tool and rotatable drill bit about a vertical axis of the at bit inclination and azimuth tool;

recording azimuth and z magnetometer sensor measurements from the at bit inclination and azimuth tool;

returning the z-axis of the at bit inclination and azimuth tool to an orientation of magnetic north;

with the z-axis fixed, rolling the at bit inclination and azimuth tool about the z-axis and record x and y magnetometer sensor measurements and a roll angle; and calculating multipliers for calibration x magnetic field component, calibration y magnetic field component and calibration z magnetic field component and calibration remanent magnetic field components associated with the at bit inclination and azimuth tool and drill bit and storing in a repository.

9. The method of claim 8, wherein the at bit inclination and azimuth tool further comprises: a first set of three axis inclinometer sensors perpendicular to a first set of three axis magnetometer sensors.

10. The method of claim 9, wherein after the step of calculating multipliers for x, y and z magnetic field components and remanent magnetic field components associated with the at bit inclination and azimuth tool and drill bit and placing the downhole drilling assembly in a borehole underneath an Earth's surface, the method further comprising:

recording measurements from the first set of three axis magnetometer sensors and the first set of three axis inclinometer sensors of the at bit inclination and azimuth tool of the downhole drilling assembly in the borehole underneath the Earth's surface;

drilling the borehole a distance, such that the steering tool is relocated to a location of the at bit inclination and azimuth tool in which measurements from the first set of three axis inclinometer sensors and the first set of three axis magnetometer sensors in the at bit inclination and azimuth tool were previously recorded with the downhole drilling assembly in the borehole underneath the Earth's surface;

recording measurements from a second set of three axis steering tool magnetometer and a second set of three axis steering tool inclinometer sensors of a steering tool of the downhole drilling assembly in the borehole underneath the Earth's surface at the location;

recalculating multiplies for x magnetic field components, y magnetic field components, and remanent magnetic field components;

comparing recalculated multipliers for the x magnetic field components, the y magnetic field components and the remanent magnetic field components to the calibration x magnetic field component, the calibration y magnetic field component and the calibration z magnetic field component and the calibration remanent magnetic field components; and retrieving the downhole drill assembly from the borehole if the recalculated multipliers for the x magnetic field components, the y magnetic field components and the remanent magnetic field components differ by greater than two degrees from the calibration x magnetic field component, the calibration y magnetic field component and the calibration z magnetic field component and the calibration remanent magnetic field components for recalibration of the downhole drilling assembly.

11. The method of claim 8, wherein prior to placing the at bit inclination and azimuth tool connected to the rotatable drill bit on the roller supports connected to the rotatable platform at the borehole site, using a steering tool of the downhole drilling assembly to obtain Earth's magnetic field along the z-axis.

12. A method of steering a downhole drilling assembly while drilling a borehole beneath the Earth's surface, the downhole drilling assembly comprising: a first proximal end and a second distal end; a rotatable drill bit positioned at the second distal end of the assembly; an at bit inclination and azimuth tool positioned immediately proximate and connected to the rotatable drill bit, wherein the at bit inclination and azimuth tool comprises a first set of three axis inclinometer sensors, a first set of three single axis magnetometer sensors, and a solenoidal alternating current magnetic coil, wherein the first set of three axis inclinometer sensors are configured to gather information related to an angular position of the rotatable drill bit; a bent sub proximally positioned and connected to the at bit inclination and azimuth tool; a downhole motor proximally positioned and coupled to the bent sub for rotating the drill bit; a steering tool proximally positioned to the downhole motor and having a second set of three axis steering tool magnetometer sensors and a second set of three axis steering tool inclinometer sensors connected to a communication device; and a drill string connected to the downhole motor and receiving the steering tool, the method comprising:

a processor of the at bit inclination and azimuth tool of the drilling assembly receiving magnetic and gravity field vector measurements from the first set of three axis inclinometer sensors and the first set of three axis magnetometer sensors of the at bit inclination and azimuth tool;

the processor of the at bit inclination and azimuth tool of the drilling assembly calculating a gravity direction and earth's apparent magnetic field of the at bit inclination and azimuth tool of the drilling assembly within the borehole;

the processor of the at bit inclination and azimuth tool of the drilling assembly removing remanent field contributions and calculating corrected values of the magnetic and gravity field vector measurements;

the processor of the at bit inclination and azimuth tool of the drilling assembly determining a corrected azimuth from the corrected values of the magnetic and gravity field vector measurements;

the solenoidal alternating current magnetic coil of the at bit inclination and azimuth tool of the drilling assembly transmitting the corrected azimuth and the corrected values of the magnetic and gravity field vector measurements from the at bit inclination and azimuth tool including the information related to the angular position of the rotatable drill bit to the steering tool; and a processor of the steering tool transmitting the corrected azimuth and the corrected values of the magnetic and gravity field vector measurements from the steering tool to an uphole processor for steering the downhole drilling assembly within the bore.

13. The method of claim 12, wherein the steering tool transmits the corrected azimuth and the corrected values of the magnetic and gravity field vector measurements from the steering tool to the uphole processor via the communication device, wherein the communication device is a telemetry wire.

14. The method of claim 12, wherein prior to the processor of the at bit inclination and azimuth tool of the drilling assembly receiving magnetic and gravity field vector measurements from the first set of three axis inclinometer sensors and the first set of three axis magnetometer sensors of the at bit inclination and azimuth, the method further comprising calibrating the at bit inclination and azimuth tool by:

placing the at bit inclination and azimuth tool connected to the rotatable drill bit on roller supports connected to a rotatable platform at a borehole site;

leveling the rotatable platform such that a z-axis of the at bit inclination and azimuth tool and rotatable drill bit is level and points along magnetic north;

rotating the at bit inclination and azimuth tool and rotatable drill bit about a vertical axis of the at bit inclination and azimuth tool;

recording azimuth and z magnetometer sensor measurements from the at bit inclination and azimuth tool;

returning the z-axis of the at bit inclination and azimuth tool to an orientation of magnetic north;

with the z-axis fixed, rolling the at bit inclination and azimuth tool about the z-axis and record x and y magnetometer sensor measurements and a roll angle; and calculating multipliers for calibration x magnetic field component, calibration y magnetic field component and calibration z magnetic field component and calibration remanent magnetic field components associated with the at bit inclination and azimuth tool and drill bit and storing in a repository.

15. A method of steering a downhole drilling assembly while drilling a borehole beneath the Earth's surface, the downhole drilling assembly comprising: a rotatable drill bit; an at bit inclination and azimuth tool connected to the rotatable drill bit, wherein the at bit inclination and azimuth tool comprises a first set of three axis inclinometer sensors and a first set of three axis magnetometer sensors; a bent sub connected to the at bit inclination and azimuth tool; a downhole motor coupled to the bent sub for rotating the drill bit; a steering tool having a second set of three axis steering tool magnetometer sensors and a second set of three axis steering tool inclinometer sensors connected to a communication device; and a drill string connected to the downhole motor and receiving the steering tool, the method comprising:

a processor of the at bit inclination and azimuth tool of the drilling assembly receiving magnetic and gravity field vector measurements comprising information related to an angular position of the rotatable drill bit from the first set of three axis inclinometer sensors and the first set of three axis magnetometer sensors of the at bit inclination and azimuth and sending the magnetic and gravity field vector measurements comprising the information related to the angular position of the rotatable drill bit to the steering tool;

a processor of the steering tool of the drilling assembly receiving the azimuth and sending the magnetic and gravity field vector measurements from the at bit inclination and azimuth tool and calculating a gravity direction and earth's apparent magnetic field of the at bit inclination and azimuth tool of the drilling assembly within the borehole;

the processor of the steering tool of the drilling assembly removing remanent field contributions and calculating corrected values of the magnetic and gravity field vector measurements;

the processor of the steering tool of the drilling assembly determining a corrected azimuth from the corrected values of the magnetic and gravity field vector measurements;

the processor of the steering tool of the drilling assembly transmitting the corrected azimuth and the corrected values of the magnetic and gravity field vector measurements from the at bit inclination and azimuth tool to the steering tool; and the processor of the steering tool transmitting the corrected azimuth and the corrected values of the magnetic and gravity field vector measurements from the steering tool to an uphole processor for steering the downhole drilling assembly within the bore.

* * * * *